US007163348B2

(12) United States Patent
Kulpa et al.

(10) Patent No.: US 7,163,348 B2
(45) Date of Patent: Jan. 16, 2007

(54) POSTAGE METER FOR PRINTING NEAR THE TOP EDGE OF AN ENVELOPE

(75) Inventors: Walter J. Kulpa, Trumbull, CT (US); Norman L. Barrigas, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 135 days.

(21) Appl. No.: 10/955,561

(22) Filed: Sep. 30, 2004

(65) Prior Publication Data

US 2005/0147449 A1 Jul. 7, 2005

Related U.S. Application Data

(60) Provisional application No. 60/481,858, filed on Jan. 5, 2004.

(51) Int. Cl.
*B41J 11/48* (2006.01)

(52) U.S. Cl. ..... 400/595; 400/26; 400/642; 271/274

(58) Field of Classification Search ..... 400/55, 400/56; 271/274
See application file for complete search history.

(56) References Cited

U.S. PATENT DOCUMENTS 4,821,049 A * 4/1989 Eckl ..... 346/134
5,806,994 A * 9/1998 Coffy et al. ..... 400/120.01
5,844,584 A 12/1998 Murphy, III et al. ..... 347/20
6,155,728 A 12/2000 Sakaino et al. ..... 400/26
6,416,176 B1 7/2002 Yasui et al. ..... 347/104
6,938,894 B1 * 9/2005 Miller et al. ..... 271/274
2002/0085871 A1 7/2002 Salomon et al. ..... 400/635
2002/0154203 A1 10/2002 Tanaka ..... 347/104
2006/0017768 A1 * 1/2006 Le Gallo ..... 347/22

FOREIGN PATENT DOCUMENTS

FR 2742693 A 6/1997

* cited by examiner

*Primary Examiner*—Daniel J. Colilla
*Assistant Examiner*—Marissa Ferguson-Samreth
(74) *Attorney, Agent, or Firm*—George M. MacDonald; Steven J. Shapiro; Angelo N. Chaclas

(57) ABSTRACT

A mailing machine including a postage meter for printing evidence of postage payment on a media includes a registration surface, a print head, an envelope transport having at least two nips for keeping the media from skewing and contacting the print head, a media ski ending upstream of the registration surface for pushing the media into contact with the registration surface, and at least one star wheel disposed in an opening of the registration surface for holding the media down as it is fed through the mailing machine.

12 Claims, 6 Drawing Sheets

POSTAGE METER FOR PRINTING NEAR THE TOP EDGE OF AN ENVELOPE

CROSS REFERENCE TO RELATED APPLICATIONS

This application claims priority under 35 U.S.C. section 119(e) from Provisional Patent Application Ser. No. 60/481,858, filed Jan. 5, 2004, entitled POSTAGE METER FOR PRINTING NEAR THE TOP EDGE OF AN ENVELOPE, which is incorporated herein by reference in its entirety.

BACKGROUND

The illustrative embodiments described in the present application are useful in systems including those for providing funds accounting and evidencing and more particularly are useful in systems including those for providing for accounting of postage and evidence of postage by printing postage indicia on an envelope using an ink jet printer.

Mailing machines including postage meters often employ an ink-jet printing unit for printing evidence of postage payment in the form of postage indicia. Systems for printing information on a mailing medium are described in U.S. Pat. No. 6,550,994B2, issued Apr. 22, 2003 to Manduley.

Certain mailing machines are not able to print near the top edge of the medium such as an envelope. However, certain markings that may be used on mail pieces must be printed near the top edge of an envelope. If a mailing machine prints a Facing Identifier mark (FIM) on an envelope, postal regulations would allow a non-fluorescent ink to be used. However, if used, the FIM must be printed within one-eighth inch from the top of the envelope.

Conventional mailing machines with postage meters that print using ink jet printing technology typically use a printing registration plate. The registration plate has an upper registration edge along the top border of the envelope in the paper path so that the surface of the envelope is constrained to be not more than 2 mm from the ink jet print head. Also, the envelope is constrained so that it does not contact the surface of the print head. If contact with the print head occurs, the printed image will be smeared and the anti-wetting coating on the face of the print head will be damaged. FIM marks must be printed near the top edge of the envelope. Since the upper registration edge on the registration plate blocks this area, ink jet printing postage meters cannot print FIM marks in the required position.

Accordingly, the prior art does not provide a mailing machine for printing near the top edge of media such as an envelope.

SUMMARY

Accordingly, it is an object of the present application to describe a mailing machine for printing near the top edge of an envelope.

The illustrative embodiments of the present application describe a mailing machine with a registration surface and print head with elements to allow FIM printing to the top edge of media such as an envelope. An envelope transport uses at least two roller nips to grip the envelope prior to its reaching the printing opening in the registration surface. An envelope ski pushes the envelope surface into contact with the registration surface prior to the opening in the registration surface. A star wheel or set of star wheels is located in the registration surface opening just downstream from the print head. An extension of the downstream normal force roller arm that supports the envelope to keep it from fish-tailing into the print head as its trailing edge passes under it is provided.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

In the illustrative mailing machine and postage meter described in the present application, a method and system for printing near the top edge of an media such as an envelope is shown.

Figure 1:
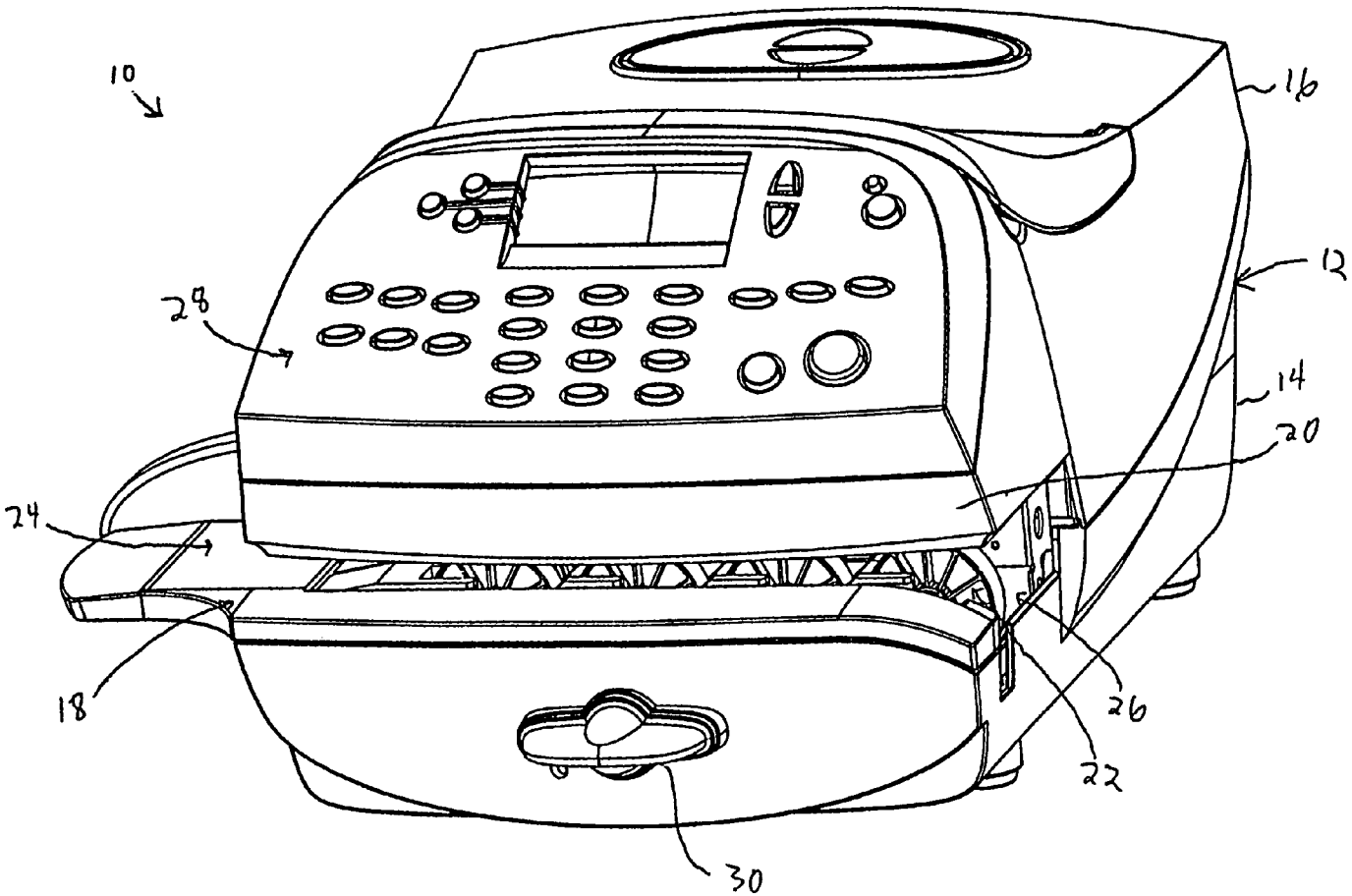
FIG. 1 is an isometric view of a postage meter in accordance with the invention.

Referring now to the drawings, and particularly to FIG. 1, the reference numeral 10 generally indicates a postage meter provided in accordance with the invention.

The postage meter 10 includes a housing 12 formed of a lower case section 14 and an upper case section 16. A slot 18 formed in the front 20 of the housing 12 allows a mail piece (not shown) to be transported through the postage meter 10. The postage meter 10 also includes a transport unit 22 (partially visible through the slot 18) positioned at the slot 18 to transport the mail piece from an infeed side 24 of the slot 18 to an outfeed side 26 of the slot 18. The postage meter 10 further includes a user interface 28 at the front 20 of the housing 12, and a lever 30 positioned below the slot 18 to aid in clearing jams from the transport unit 22.

Figure 2:
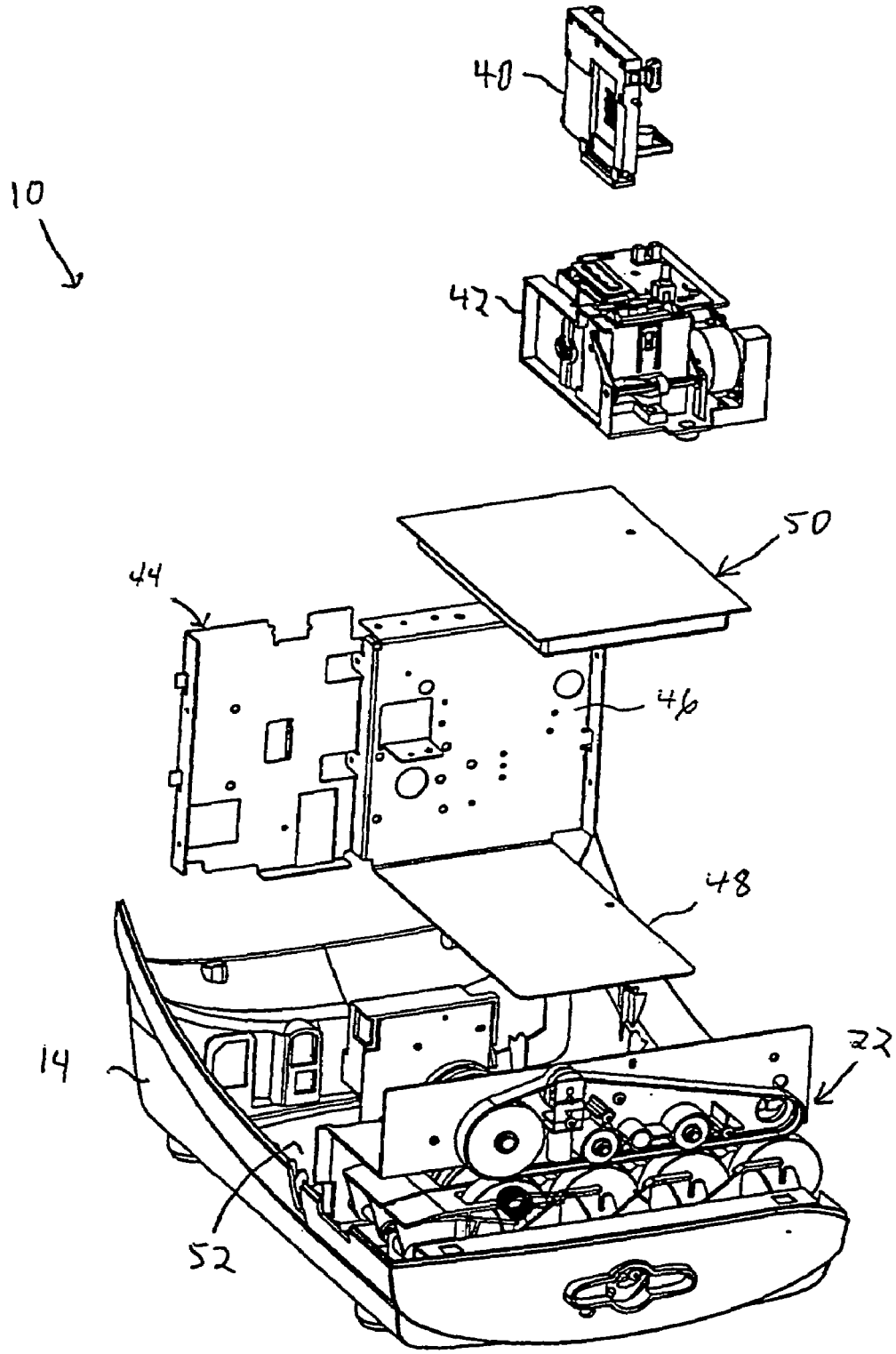
FIG. 2 is a partially exploded view showing some of the internal components of the postage meter of FIG. 1.

FIG. 2 shows a partially exploded view showing some of the internal components of the postage meter 10. In addition to the above-mentioned transport unit 22 (which is more clearly visible in FIG. 2), the postage meter 10 includes an ink jet print head 40. In accordance with conventional practices, the transport unit 22 may operate to transport a mail piece (not shown) past the print head 40 so that the print head 40 may print a postage indicium on the mail piece.

The postage meter 10 also includes a waste ink purge unit 42. At appropriate times, the purge unit 42 may come into engagement with the print head 40 to remove excess ink, dried or partially dried ink and/or air bubbles from the print head 40. By a mechanism which is not shown, the print head 40 may be moveable in fore-and-aft directions between a print position adjacent the front of the meter 10 and a purge position that is aft of the print position. When in the print position, the print head 40 may operate to print postage indicia on mail pieces. When in the purge position, the print head 40 may be purged of waste ink by the purge unit 42.

The postage meter 10 further includes a metal chassis 44. The metal chassis 44 includes a vertical section 46 to which certain components (not shown in FIG. 2) of the postage meter 10 may be mounted. The metal chassis 44 also includes a horizontal metal plate 48 which may be integrally formed with at least part of the vertical section 46 of the metal chassis. The metal plate 48 extends horizontally outwardly from the metal chassis 44 in a forward direction.

Also included in the postage meter 10 is a waste ink tray assembly 50. When the postage meter 10 is in an assembled condition (not shown in FIG. 2), the metal chassis 44 may rest on the bottom 52 of the lower case section 14 of the housing 12, with the waste ink tray assembly 50 supported by and resting on the metal plate 48. When the postage meter 10 is in its assembled condition, the waste ink tray assembly 50 is positioned below the purge unit 42 to receive from the purge unit 42 waste ink removed from the print head 40 by the purge unit 42.

Figure 3:
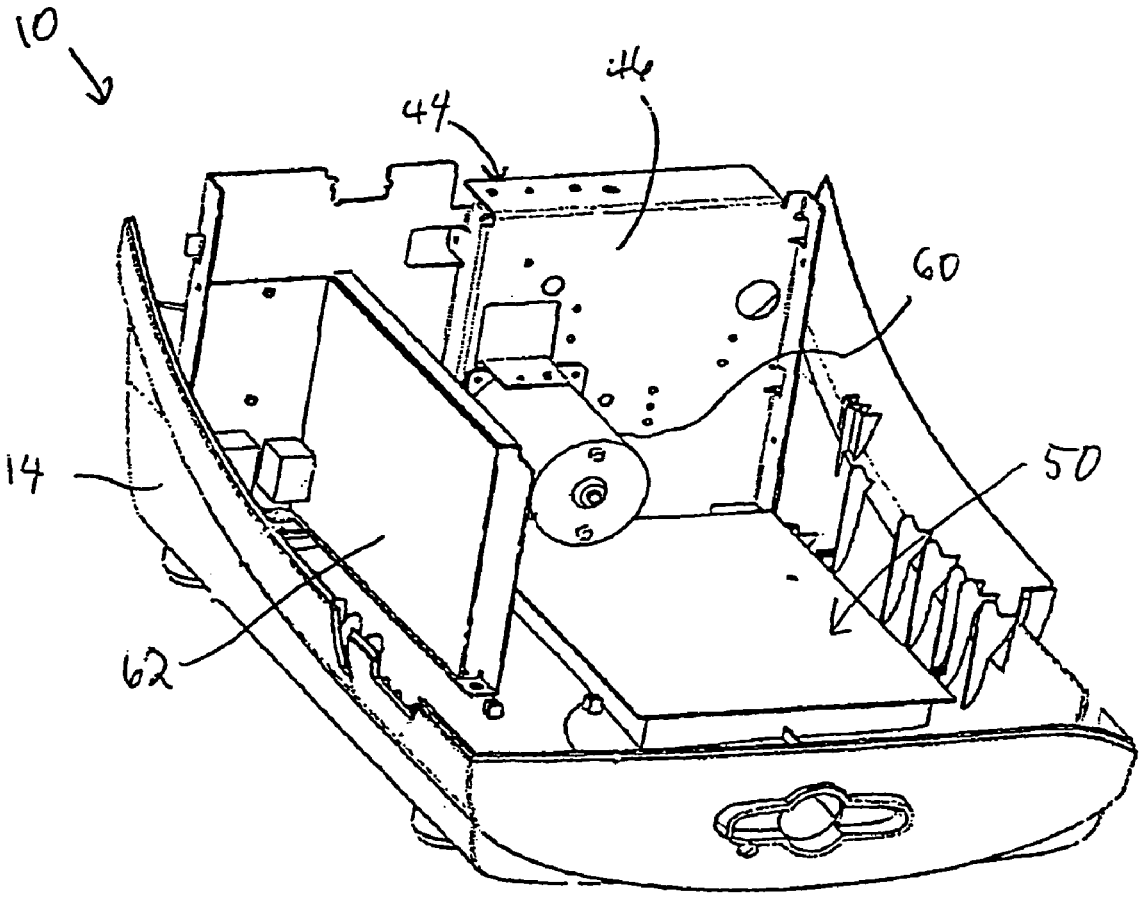
FIG. 3 is an isometric view showing the interior of the postage meter of FIG. 1, with some of its internal components removed.

Referring to FIG. 3, an isometric view showing the interior of the postage meter 10, with some of its internal components removed is shown. For example, the transport unit 22, purge unit 42 and print head 40 shown in FIG. 2 are omitted from FIG. 3 to allow other components to be more readily seen.

As shown in FIG. 3, the postage meter 10 includes a motor 60 mounted on the vertical section 46 of the metal chassis 44 above the waste ink tray assembly 50. A shaft and pulley arrangement, which is not shown, may be provided to couple the motor 60 to the transport unit 22 (FIGS. 1 and 2, not shown in FIG. 3) to allow the motor 60 to drive the transport unit 22 so that the transport unit 22 may transport mail pieces through the slot 18 (FIG. 1) and past the print head 40 (FIG. 2).

The postage meter 10 also includes a power supply 62 mounted on the vertical section 46 of the metal chassis 44 to the right of the motor 60 and the waste ink tray assembly 50. The power supply 62 supplies power to the motor 60 and to other components (not shown in FIG. 3) of the postage meter 10. For example, the power supply may supply power to the purge unit 42. During operation of the postage meter 10, the power supply 62 and/or the motor 60 may generate excess heat, which is conducted through the metal chassis 44 to the metal plate 48 (FIG. 2) on which the waste ink tray assembly 50 rests.

Figure 4:
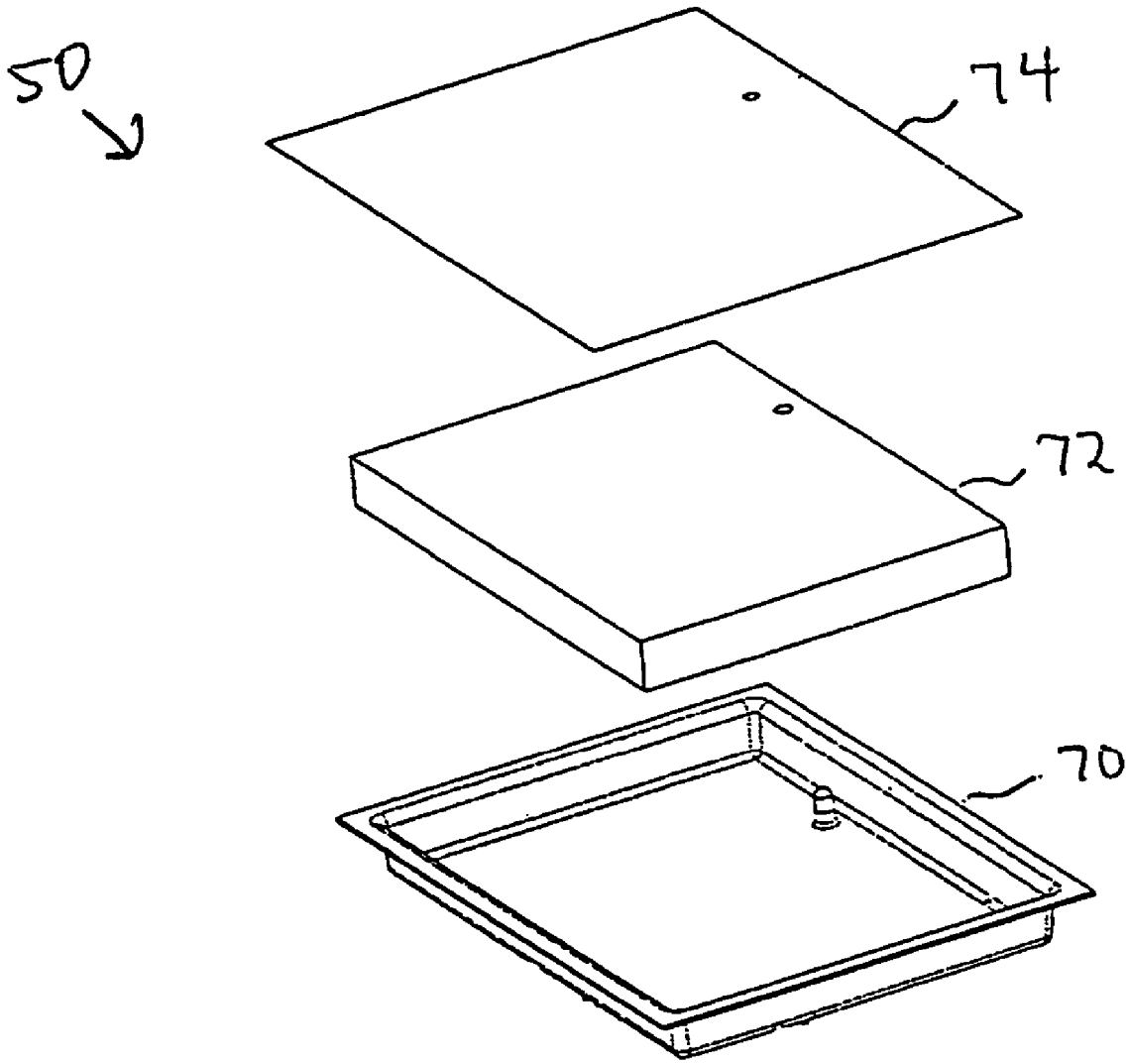
FIG. 4 is an exploded view of a waste ink tray assembly that is shown in FIGS. 2 and 3.

Referring to FIG. 4, an exploded view of the waste ink tray assembly 50 is shown. As shown in FIG. 4, the assembly 50 includes an ink tray 70, an absorbent pad 72 (which is held in the ink tray 70 when the assembly 50 is in an assembled condition) and a cover membrane 74. The cover membrane 74 covers the pad 72 and substantially closes the ink tray 70 when the assembly 50 is in the assembled condition. The cover membrane 74 may be such as to allow vapor to pass therethrough while substantially preventing passage of liquids.

In operation of the postage meter 10, the power supply 62 is energized. Mail pieces are presented seriatim to the infeed side 24 of the slot 18 and are transported by the transport unit 22 (driven by motor 60) through the slot 18 past the print head 40, which prints postage indicia on the mail pieces. The mail pieces are then ejected from the outfeed side 26 of the slot 18.

On appropriate occasions, the print head 40 is moved from its print position (not shown) to its purge position (not shown), to allow the purge unit 42 to engage the print head. By action of one or both of the purge unit 42 and the print head 40, excess ink, dried or partially dried ink and/or air bubbles are removed from the print head 40 by the purge unit 42. The resulting waste ink is transported by the purge unit 42 to the waste ink tray assembly 50 and received by the pad 72 and the ink tray 70.

Referring to FIGS. 5–8, an illustrative mailing machine and postage meter according to an embodiment of the present application is shown.

In a mailing machine that transports an envelope past an ink jet print head, a registration surface is typically provided to constrain the surface of the envelope and often uses a top edge of the registration surface along the top border of the envelope. Here, it is desirable to constrain the surface of the media to not more than 2 mm from the ink jet print head in order to produce sufficiently precise printing. Furthermore, the envelope is preferably prevented from contacting the surface of the print head to prevent smearing of the image and abrasive damage to the non-wetting coating on the print head. An opening is typically provided in the registration surface for the ink from the print head to reach the surface of the envelope. In addition, the opening typically extends downstream from the print head so that the newly applied ink is not smeared as it is transported.

The United States Postal Service allows the use of non-fluorescent indicium if a FIM mark is printed with its top edge at the top edge of the envelope or within one-eighth of an inch of the top of the envelope. Additionally, other postal authorities also have similar FIM requirements.

Therefore, for a mailing machine to print near the top edge of the envelope, there can be no registration surface along the top border of the envelope to hold it away from contact with the print head in a mailing machine because such a surface would prevent printing in that area. Additionally, it may be undesirable to have the surface of the envelope contacting the print head because such contact may damage the print head and leave unwanted ink marks on the envelope surface.

Figure 5:
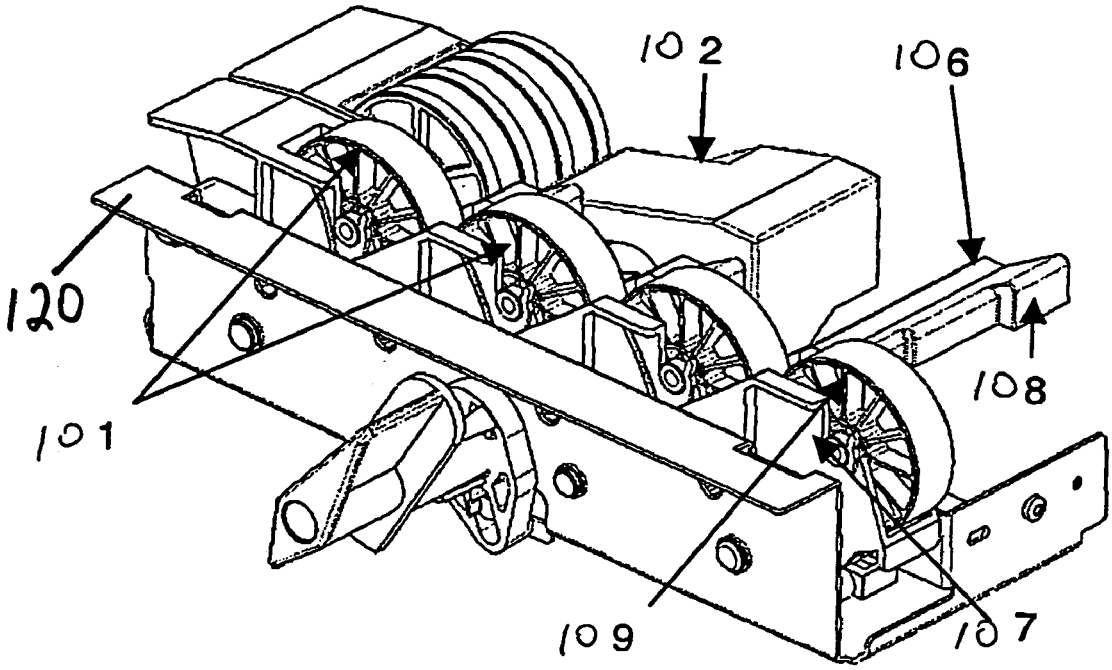
FIG. 5 is a partially exploded view showing internal components of the postage meter of FIG. 1.

Referring to FIG. 5, a partially exploded view showing internal components of the postage meter 10 including a lower section 120 of a media transport subsystem 130 is shown. Accordingly, the illustrative embodiment described herein utilizes one or more of several media control systems to allow printing to the top edge of an envelope without using a registration surface along the top border of the envelope to hold it away from the print head. The first system or element described is an envelope transport that has the envelope gripped in at least two roller nips 101 prior to its reaching the printing opening in the registration surface. This helps keep the envelope from skewing, jamming and contacting the print head.

Figure 6:
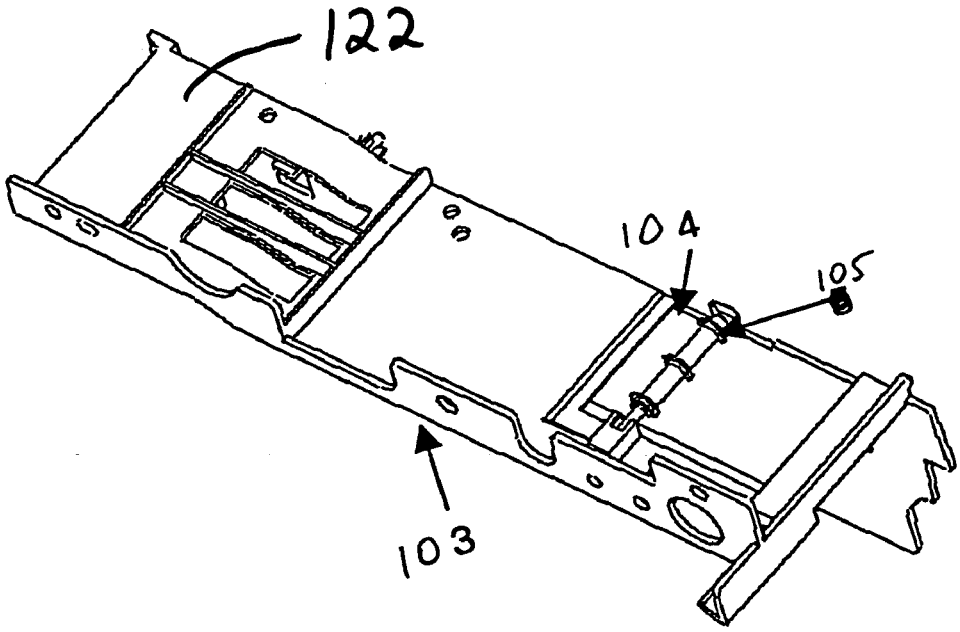
FIG. 6 is a partially exploded view showing internal components of the postage meter of FIG. 1.

Referring to FIG. 6, a partially exploded view showing internal components of the postage meter 10 including a middle section 122 of a media transport subsystem 130 is shown. As shown in FIG. 5 and FIG. 6, the second system or element described is an envelope ski 102 that pushes the envelope surface into contact with the registration surface 103 prior to the opening in the registration surface 104. The ski 102 ends just upstream of the registration surface opening 104 so that it does not push the envelope up through it. Since the ink jet print head is located very close to this opening, the envelope surface does not have an opportunity to significantly drop away from the registration surface. The combination of the ski 102 and the roller nips 101 grip the envelope like a cantilever beam keeping its lead edge from contacting the print head damaging it and getting ink on the envelope lead edge. It also keeps the envelope in the proper printing plane as it passes under the print head.

As shown in FIG. 6, the third system or element is a set of three star wheels 105 or optionally a star wheel located in the registration surface opening 104 just downstream from the print head portion or surface where the print head dispenses ink. They help to hold the envelope surface down while they tiptoe through the recently printed ink on the surface of the envelope.

As shown in FIG. 5, the fourth system or element is an extension 106 of the downstream normal force roller arm 107 that supports the envelope to keep it from fishtailing into the print head as its trailing edge passes under it. Such fishtailing into the print head is undesirable as it may leave an ink mark on the trailing edge of the envelope and could damage the print head.

In this illustrative embodiment, the extension feature 108 ends slightly upstream of the last transport roller nip 109 to prevent the feature from causing a drag force on the envelope that could skew it as it exits the transport. Since this extension travels with the normal force roller and is located below it, it can never push the envelope through the registration surface opening. It also supports the downstream end of the cantilevered envelope so that it does not move beyond the desired distance from the print head and cause poor print quality.

Figure 7:
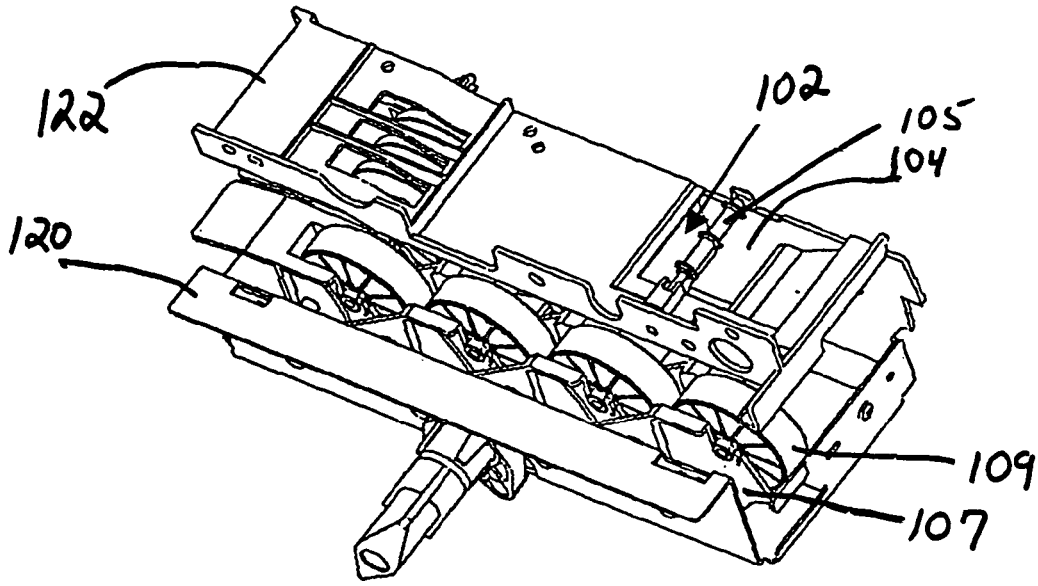
FIG. 7 is a partially exploded view showing internal components of the postage meter of FIG. 1.

Referring to FIG. 7, a partial cutaway of a media transport subsystem 130 of an illustrative mailing machine 10 according to an embodiment of the present application is shown. The lower section 120 and middle section 122 of the media transport subsystem 130 is shown. The downstream vertical surface of the ski 102 is slightly upstream of the opening in the registration plate 104. The set of three star wheels 105 is shown in the middle section 122 and the final roller 109 and normal force roller arm 107 is shown in the lower section 120.

Figure 8:
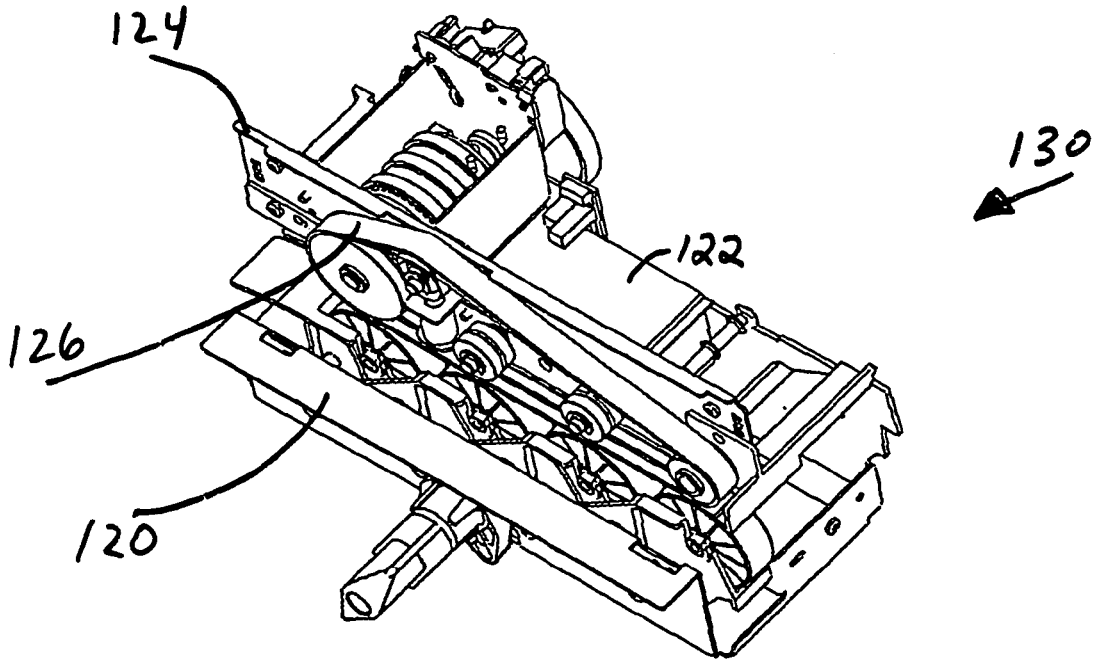
FIG. 8 is a partially exploded view showing internal components of the postage meter of FIG. 1.

Referring to FIG. 8, partial cutaway of a media transport subsystem 130 of an illustrative mailing machine 10 according to an embodiment of the present application is shown. The lower section 120, middle section 122 and upper section 124 of the media transport subsystem 130 are shown. The media transport subsystem assembly 130 is shown with the transport belt 126 included.

The present application describes illustrative embodiments of a system and method for printing near the top edge of media such as an envelope. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

What is claimed is:

1. A printer for printing on a media comprising:

a registration surface having a registration surface opening;

a print head having an ink dispensing surface;

an envelope transport having at least two nips upstream of the print head ink dispensing surface for keeping the media from skewing and contacting the print head;

a media ski ending upstream of the registration surface opening for pushing the media into contact with the registration surface; and at least one star wheel disposed in an opening of the registration surface for holding the media down as it is fed through the printer, wherein, the media ski ends slightly upstream of the registration surface opening, and further comprising:

a downstream normal force roller arm; and a final transport roller nip upstream of the at least two nips, wherein the downstream normal force roller arm includes a normal force roller arm extension located upstream of the media ski and slightly upstream of the final transport roller nip for supporting the media to keep it from fishtailing into the print head.

2. The printer according to claim 1, wherein the at least one star wheel comprises three star wheels.

3. The printer according to claim 1, wherein the at least one star wheel is located slightly downstream of the print head ink dispensing surface.

4. The printer according to claim 1, wherein the at least one star wheel is located slightly downstream of the print head ink dispensing surface.

5. A mailing machine for printing evidence of postage payment on an envelope comprising:

a registration surface having a registration surface opening;

a print head having an ink dispensing surface for printing evidence of postage payment;

an envelope transport having at least two nips upstream of the print head ink dispensing surface for keeping the envelope from skewing and contacting the print head;

a media ski ending upstream of the registration surface opening for pushing the envelope into contact with the registration surface; and at least one star wheel disposed in an opening of the registration surface for contacting the media and holding the envelope down as it is fed through the mailing machine, wherein the media ski ends slightly upstream of the registration surface opening, and further comprising:

a downstream normal force roller arm; and a final transport roller nip upstream of the at least two nips, wherein the downstream normal force roller arm includes a normal force roller arm extension located upstream of the media ski and slightly upstream of the final transport roller nip for supporting the media to keep it from fishtailing into the print head.

6. The mailing machine according to claim 5, wherein the at least one star wheel comprises three star wheels.

7. The mailing machine according to claim 5, wherein the at least one star wheel is located slightly downstream of the print head ink dispensing surface.

8. The mailing machine according to claim 5, wherein the at least one star wheel is located slightly downstream of the print head ink dispensing surface.

9. A mailing machine for printing evidence of postage payment on an envelope comprising:

a registration surface having a registration surface opening;

a print head having an ink dispensing surface for printing evidence of postage payment;

media transport means for transporting an envelope for keeping the envelope from skewing and contacting the print head;

media ski means for pushing the envelope into contact with the registration surface; and star wheel means for contacting the media and holding the envelope down as it is fed through the mailing machine, wherein the media ski means ends slightly upstream of the registration surface opening and further comprising:

a downstream normal force roller arm; and a final transport roller nip upstream of the at least two nips, wherein the downstream normal force roller arm includes a normal force roller arm extension located upstream of the media ski and slightly upstream of the final transport roller nip for supporting the media to keep it from fishtailing into the print head.

10. The mailing machine according to claim 9, wherein the star wheel means comprises three star wheels.

11. The mailing machine according to claim 9, wherein the star wheel means is located slightly downstream of the print head ink dispensing surface.

12. The mailing machine according to claim 9, wherein the star wheel means is located slightly downstream of the print head ink dispensing surface.

* * * * *